United States Patent [19]

Nielsen, Jr.

[11] Patent Number: 5,046,747

[45] Date of Patent: Sep. 10, 1991

[54] RECREATIONAL AND SPORTING DEVICE

[76] Inventor: Anker J. Nielsen, Jr., 410 Bailey Rd., Holden, Mass. 01520

[21] Appl. No.: 451,829

[22] Filed: Dec. 18, 1989

[51] Int. Cl.[5] ..... B62M 1/00

[52] U.S. Cl. ..... 280/11.28; 280/87.042

[58] Field of Search ..... 280/11.19, 11.2, 11.27, 280/11.28, 87.042, 87.041, 62

[56] References Cited

U.S. PATENT DOCUMENTS

| | | | |
|---|---|---|---|
| D. 214,177 | 5/1969 | Greer | 280/87.042 |
| 1,467,453 | 4/1922 | Remacle | 280/87.042 |
| 4,043,566 | 8/1977 | Johnson | 280/87.042 |
| 4,152,001 | 5/1979 | Christianson | 280/11.28 |
| 4,199,165 | 4/1980 | Spitzke | 280/87.042 |

*Primary Examiner*—Andres Kashnikow
*Assistant Examiner*—Richard Camby
*Attorney, Agent, or Firm*—Irving M. Kriegsman

[57] ABSTRACT

A board type recreational and sporting device for use in riding down an inclined surface includes an elongated platform for supporting a rider in a generally upright position. The platform has a front portion, a central portion and a rear portion. A front wheel is mounted on the front portion of the platform and pair of back wheels are mounted on the central portion of the platform. The rear wheels are mounted on the platform through a pair of leaf springs which are constructed and oriented on the platform so as to enable steering of the board by changing the position of one of the feet of the rider on the platform and the distribution of the weight of the rider on the platform. A brake plate is fixedly mounted on the back portion of the platform for use in slowing down the device when necessary as it traverses the surface and a rope is attached to the front portion of the platform for to assist providing balance, turning and slowing down of the device.

8 Claims, 5 Drawing Sheets

RECREATIONAL AND SPORTING DEVICE

BACKGROUND OF THE INVENTION

The present invention relates generally to recreational and sporting devices and more particularly to recreational and sporting devices of the type comprising a board on which a person stands in a generally upright position and travels over a surface or water.

Recreational and sporting devices comprising a board on which a person stands in a generally upright position and travels over a surface or water are very well known in the art. One such type of device is the surfboard which is constructed for use on water. Another such type of device is the skateboard which is constructed for use on paved or other kinds of finished surfaces. Other such devices include the snow board which is used on snow covered surfaces and the monoski both which is also are used on snow covered surfaces.

In all of the above described devices, steering is achieved by shifting the weight of the rider on the board.

The need exits for a board type recreational and sporting device on which a person stands and which could be used in riding down a grass covered or dirt covered surfaces such as for example a ski slope in the summertime when there is no snow or in riding down any other type of inclined snowfree surface.

It is an object of this invention to provide a new and improved type of recreational and sporting device.

It is another object of this invention to provide a new and improved board type recreational and sporting device.

It is still another object of this invention to provide a board type device which is constructed for use on snowless inclined surfaces.

The above and other objects are achieved according to this invention by providing a device comprising a board which is mounted on wheels and wherein the wheels are attached to the board in a manner such that the board can be steered by changing the position of one of the feet of the rider on the board and by shifting the weight of the rider on the board. The device does not require any auxiliary equipment.

SUMMARY OF THE INVENTION

A board type recreational and sporting device constructed according to the teachings of the present invention comprises an elongated platform for supporting a rider in a generally upright position, the platform having a front portion, a central portion and a back portion, a front wheel mounted on front portion of the platform and a pair of back wheels mounted on the central portion of the platform, the back wheels being mounted on the central portion of the platform in a manner so as to enable steering of the device by changing the position of one of the feet of the rider on the platform and by changing the distribution of the weight of the rider on the platform.

Various features and advantages will appear from the description to follow. In the description, reference is made to the accompanying drawing which forms a part thereof, and in which is shown by way of illustration, a specific embodiment of practicing the invention. This specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENTS

Figure 1:
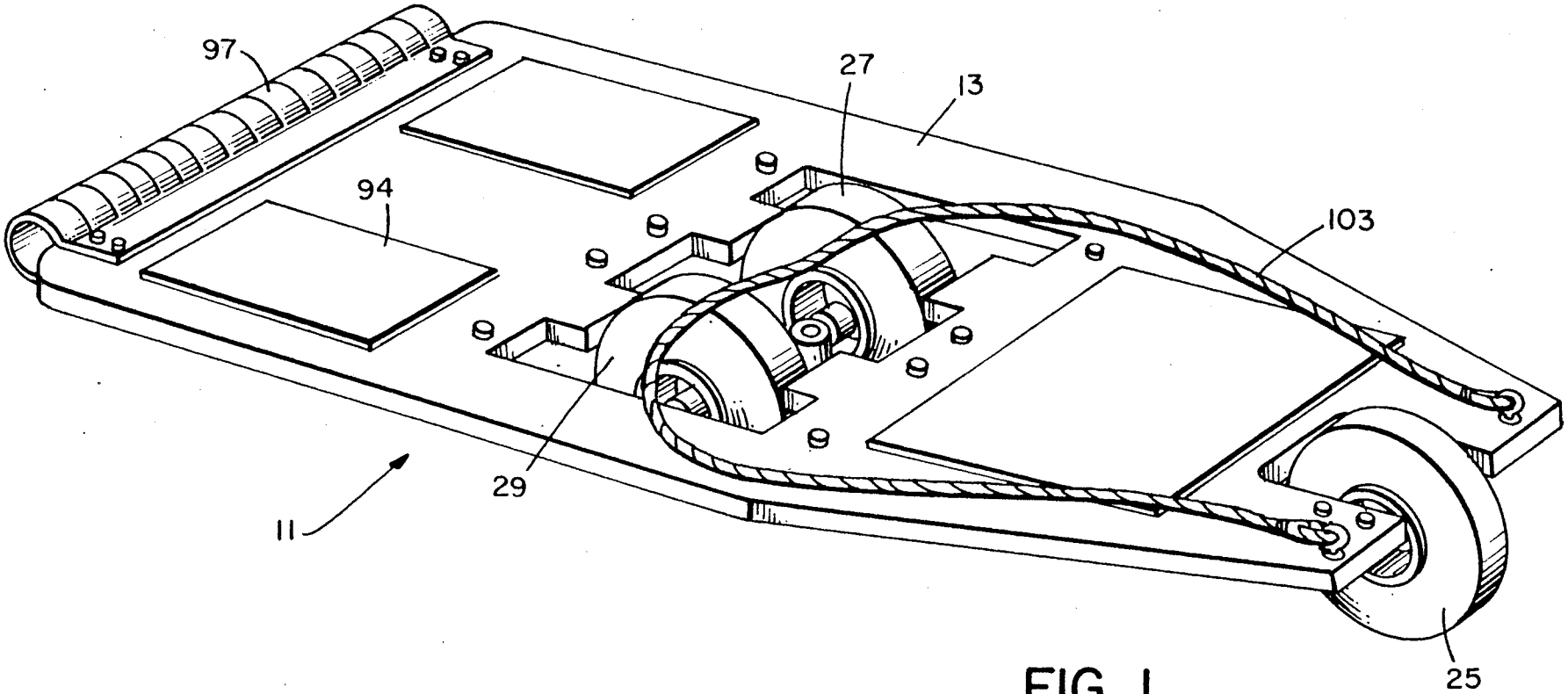
FIG. 1 is a perspective view of a recreational and sporting device constructed according to the teachings of the present invention.

Referring now to the drawings there is shown a recreational and sporting device constructed according to the teachings of the present invention and identified generally by reference numeral 11.

Device 11 comprises an elongated platform (i.e. board) 13 having a top surface 13-1 and a bottom surface 13-2. Platform 13-1 is made of a material suitable for supporting a rider, such as metal or fiberglass or plywood. Platform 13 has a front portion 15, a central portion 17 and a back portion 19. The side edges 21 and 23 of front portion 15 taper inward in a forward direction as shown.

A front wheel assembly 25 and left and right rear wheel assemblies 27 and 29, respectively, are provided for rollably supporting platform 13 on a surface.

Front wheel assembly 25 is fixedly mounted in a generally rectangular slot 26 formed on the front edge 28 of front portion 15 of platform 13. Rear wheel assemblies 27 and 29 are fixedly mounted in a generally rectangular opening 30 formed in the center of central portion 17 of platform 13.

Front wheel assembly 25, comprises a pair of L shaped mounting brackets 31 and 33, an axle 35 and a wheel 37 having a pneumatic tire 38. Brackets 31 and 33 are fixedly mounted on platform 13 using conventional hardware such as nuts 39 and bolts 41. Axle 35 extends through a circular hole formed in bracket 31 and a circular hole formed in bracket 33. A shoulder (not shown) formed near each end of axle 35 keeps axle 35 in place on brackets 31 and 33. Wheel 37 is rotatably mounted on axle 35. Thus, wheel 37 is rotatably mounted relative to platform 13.

Left rear wheel assembly 27 includes left and right elongated, longitudinally disposed, parallel, leaf springs 43 and 45, respectively, an axle 47 and a wheel 49 having a pneumatic tire 50.

Figure 3:
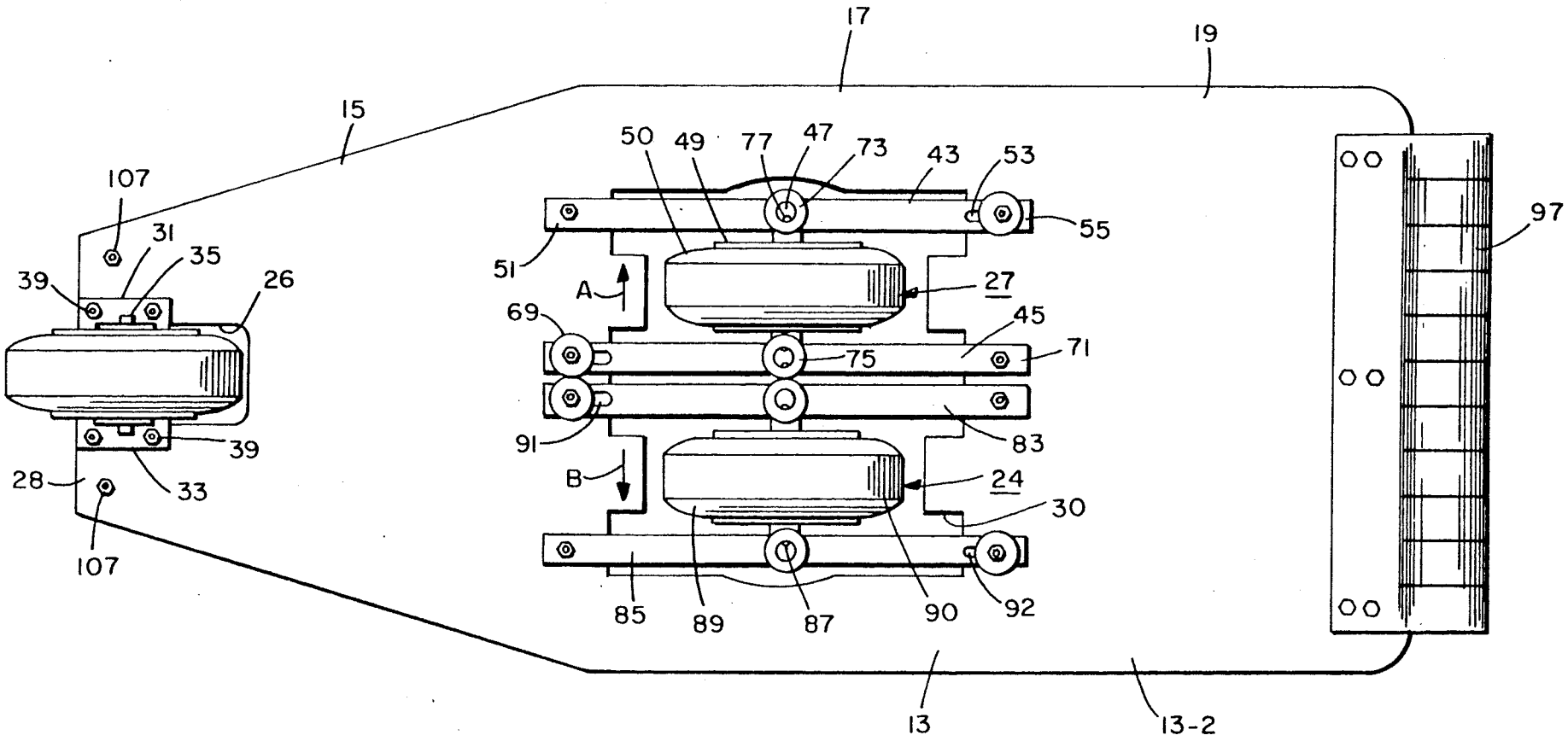
FIG. 3 is a bottom view of the device shown in FIG. 1.
Figure 4:
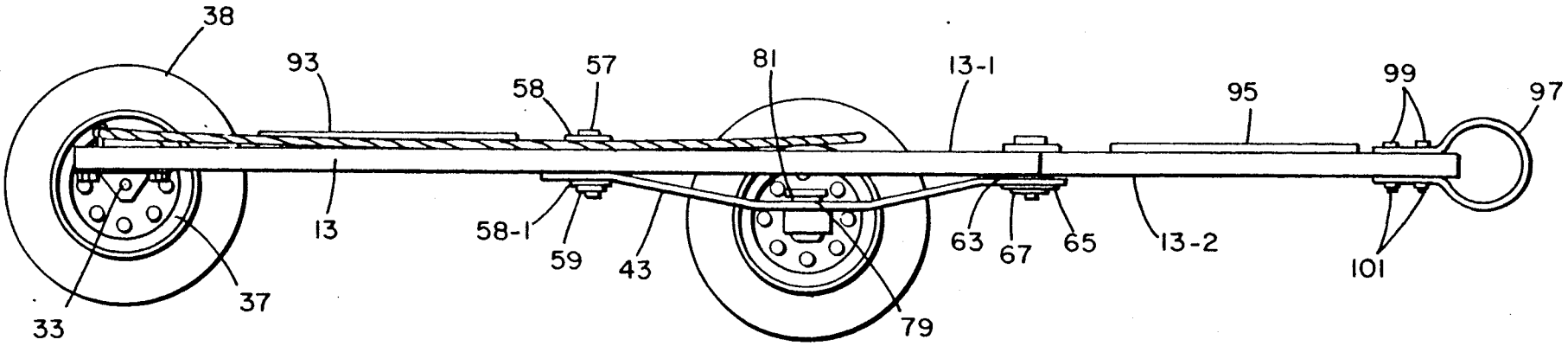
FIG. 4 is a side view of the device shown in FIG. 1.
Figure 5:
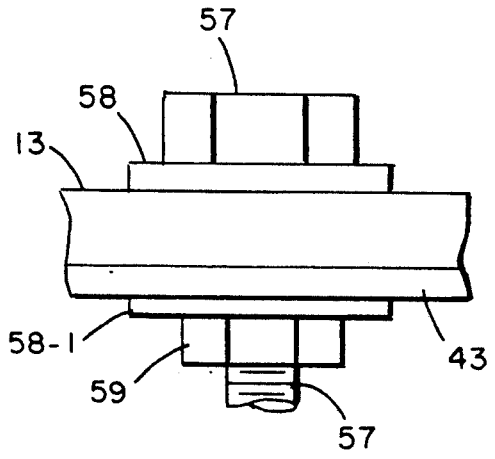
FIGS. 5–7 are enlarged fragmentary side views of the device at different locations along its length, FIG. 7 being partly broken away.
Figure 6:
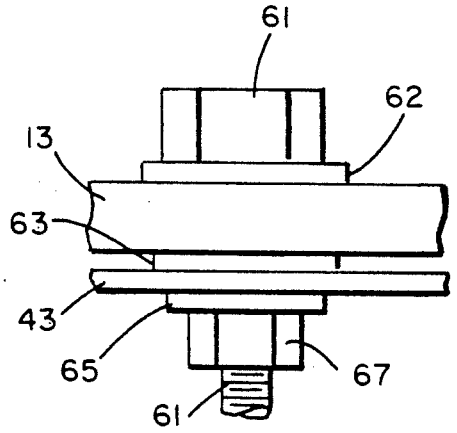
Figure 7:
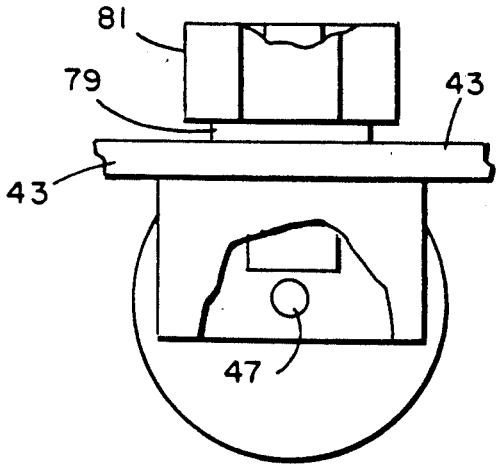

Leaf spring 43 has a hole (not shown) at its forward end 51 and a longitudinal slot 53 at its rearward end 55 (see FIG. 3). End 51 of spring 43 is fixedly mounted on platform 13 by a bolt 57 which extends through a washer 58, through a hole in platform 13, through the hole at end 51 of spring 43, through another washer 58-1 and which is secured by a nut 59. End 55 of spring 43 is slidably mounted on platform 13 by a bolt 61 which extends through a washer 62, through a hole in platform 13 through slot 51, through a pair of washers 63 and 65, one on each side of leaf spring 43, and which is secured by a nut 67.

Leaf spring 45 is identical to leaf spring 43, except that the slot is at its forward end 69 rather than the rear end and the hole is at the rearward end 71 rather than the front end. Leaf spring 45 is mounted on platform 13 with the same type of hardware used to mount leaf spring 43 on platform 13.

Axle 47 is swivelly mounted on leaf springs 43 and 45 by a pair of swivel bushings 73 and 75. Swivel bushing 73 is attached to leaf spring 43 through a bolt 77 which extends through bushing 73, through a hole in leaf spring 43, through a lockwasher 79 and which is secured in place by a nut 81. Swivel bushing 75 is attached to leaf spring 45 in the same manner as swivel bushing 73 is attached to leaf spring 43. Axle 47 extends through a hole (not shown) in each swivel bushing 79. Wheel 37 is rotatably mounted on axle 47.

Figure 2:
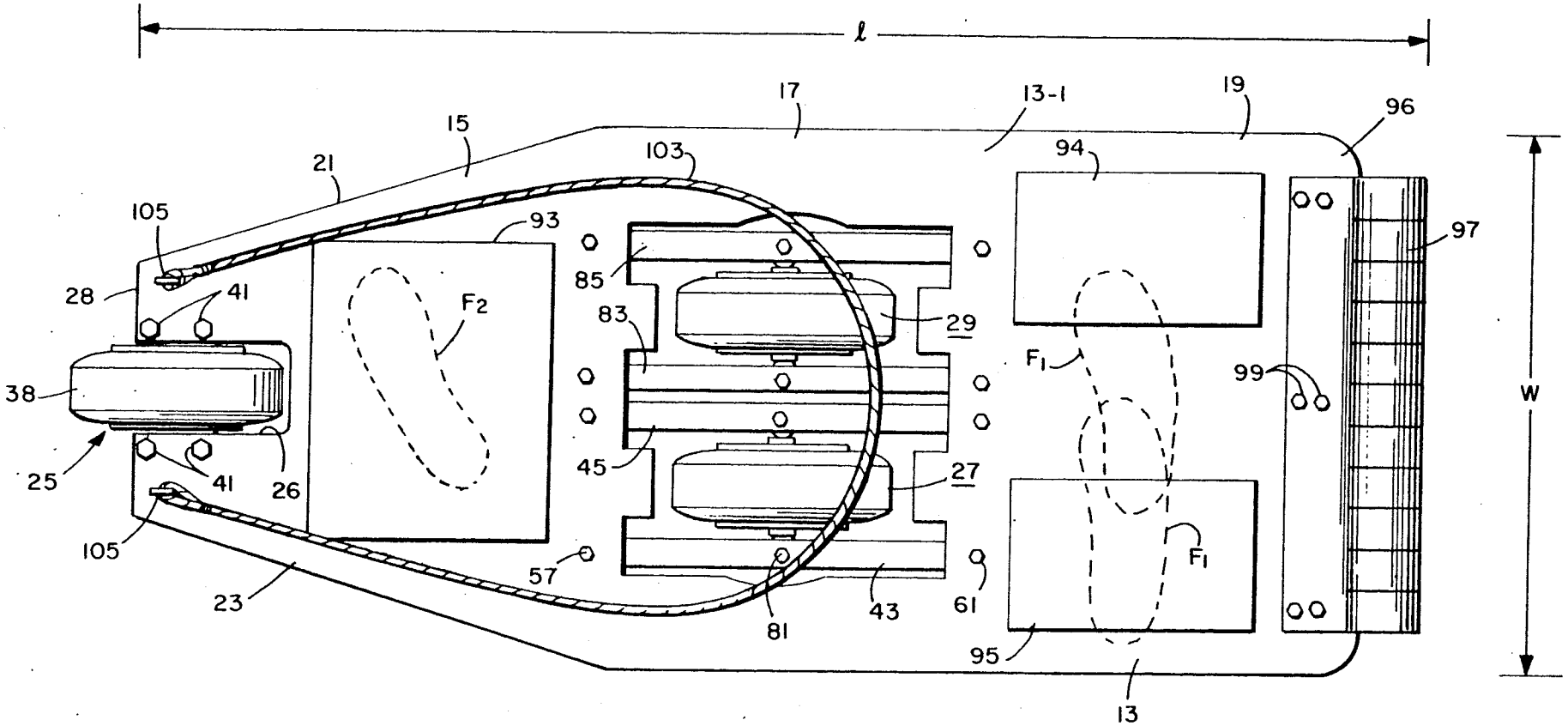
FIG. 2 is a top view of the device shown in FIG. 1.

As can be seen, when leaf springs 43 and 45 are depressed, rearward end 55 of leaf spring 43 will slide back on platform 13 and forward end 69 of leaf spring 45 will slide forward on platform 13 causing axle 47 to swivel relative to leaf springs 43 and 45 and rotate (i.e. turn) in a clockwise direction as shown by arrow A in FIG. 3 (i.e. a counterclockwise direction as seen in FIG. 2).

Thus, wheel 37 is rotatably and pivotally mounted relative to platform 13, the pivotal movement being achieved by depressing leaf springs 43 and 45.

Right rear wheel assembly 29 includes left and right elongated longitudinally disposed, parallel leaf springs 83 and 85, an axle 87 and a wheel 89 on which is mounted a rubber pneumatic type tie 90. Right rear wheel assembly 29 differs from left rear wheel assembly 27 in that the slots and holes on the leaf springs are reversed. More specifically, left leaf spring 83 has a slot 91 at the forward end and a hole at the rearward end while leap spring 85 has a hole at the forward end and a slot 92 at the rearward end. Consequently, when leaf springs 83 and 85 are depressed, axle 87 will rotate in a counterclockwise direction as shown by arrow B in FIG. 3 (i.e. a clockwise direction as seen in FIG. 2).

A set of three pads 93, 94 and 95 are provided to prevent slippage of the feet of the rider when standing on top surface 13-1 of platform 13 as will hereinafter be described. Pads 93–95 may be made of rubber or any other suitable material. Pad 91 is fixedly mounted by an adhesive or other suitable means (not shown) on front portion 15 on top surface 13-1 of platform 13 while pads 93 and 95 are fixedly mounted by an adhesive or other suitable means (not shown) on back portion 19 on top surface 13-1 of platform 13.

A brake plate 97 for use in slowing down device 11 is fixedly mounted on the back end 96 of platform 13 by bolts 99 and nuts 101. Brake plate 97 is shaped in the form of an elongated substantially cylindrical member. A plurality of lateral slots are formed on the cylindrical member to give individual springing effect over the length of the member and thus conform to the contour of the surface over which the device is traveling. A rope 103 for assisting in providing stability, balance and slowing down device 11 and also for pulling device 11 when the rider is not mounted thereon is attached to the front end of platform 13 by a pair of eye bolts 105 and nuts 107.

When using device 11 to ride down an inclined surface, the rider stands on platform 13 with one foot at about the center of front portion 15 and the other foot at about the center of back portion 19, as shown by feet F1 and F2 in FIG. 2, similar to the way a person stands on a surfboard or snow board, and holds on to rope 103 and puts his weight primarily on his front foot F2. Since there is very little weight on the back foot F1, leaf springs 43, 45, 83 and 85 are essentially not depressed.

Slowing down device 11 is achieved by shifting the weight of the person to the rear portion of platform 13 so that platform 13 tilts backward on rear wheels 37 and 89 causing brake plate 97 to scrape against the surface on which the device is traveling. The scraping action may be increased by pulling up on rope 103. Also, since the weight of the rider is primarily at the back the four leaf springs will be depressed causing the back wheels to pivot in opposite directions, also causing braking action.

To make a left turn, the rider moves his back foot from the center of back portion 19 to the left side on platform 13 as shown by the foot F1 in FIG. 2, puts all his weight on his back foot and pulls up on rope 103. This will lift front wheel 37 and right rear wheel 89 off of the surface so that device 11 will basically be riding solely on wheel 37. At the same time, since the weight of the rider is on the back left portion of platform 13, leaf springs 43 and 45 will be depressed causing wheel 37 to turn to the left. This causes device 11 to turn to the left.

A right turn is achieved in a similar way, namely, by moving the back foot to the right on platform 13, shifting all the weight of the rider to the back foot and then pulling up on rope 103.

By way of example, the length l and width w of platform 13 (see FIG. 2) may be 46 inches by 20 inches, respectively.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A board type recreational and sporting device comprising:

a. an elongated platform configured for supporting a rider in a generally upright position, said platform having a front portion, a central portion and a back portion, the central portion being between the front portion and the back portion, b. a front wheel, c. means rotatably mounting said front wheel on the front portion of the platform, d. a pair of back wheels, e. first means for rotatably and pivotally mounting one of said back wheels on the central portion of the platform and second means for rotatably and pivotally mounting the other of said back wheels on the central portion of the platform, wherein said first means is separate from said second means and wherein said first means and said second means permit steering of the device in accordance with the position of the feet of the rider on the platform and the distribution of the weight of the rider on the platform, said platform includes an opening through which each of said rear wheels extends.

2. The device of claim 1 and wherein the platform is configured for supporting the rider with one foot on the front portion of the platform and the other foot on the back portion of the platform.

3. A board type recreational and sporting device comprising:

a. an elongated platform configured for supporting a rider in a generally upright position, said platform having a front portion, a central portion and a back portion, b. a front wheel, c. means rotatably mounting said front wheel on the front portion of the platform, d. a pair of back wheels, and e. means rotatably and pivotally mounting each one of said back wheels on the central portion of the platform in a manner so as to enable steering of the device in accordance with the position of the feet of the rider on the platform and the distribution of the weight of the rider on the platform, said means rotatably and pivotally mounting each one of said back wheels on the central portion of the platform comprising a pair of elongated leaf springs, an axle, and means for attaching the axle to the pair of leaf springs, the back wheel being mounted on the axle, each leaf spring being fixedly mounted at one end on the platform and being slidably mounted at the other end on the platform in a manner such that depressing the leaf springs will result in a pivotal turning of the axle.

4. The device of claim 3 wherein the means for attaching the axle to the pair of leaf springs comprise a pair of swivel bushings.

5. The device of claim 4 and further including brake means attached to said platform for slowing down movement of the device.

6. The device of claim 5 and further including a rope attached to the front portion of the platform to assist in providing balancing, turning and stopping.

7. A recreational and sporting device comprising:

a. an elongated generally flat platform configured for supporting a rider in a generally upright position, said platform including a front portion, a central portion and a rear portion, b. bracket means fixedly mounted on said front portion of the platform, c. a front axle on said bracket means, d. a front wheel on said front axle, e. two pairs of elongated leaf springs longitudinally disposed at said central portion of said platform in side by side relationship, each leaf spring having one end fixedly mounted on said platform and the other end slidably mounted on said platform, f. a rear axle attached to each pair of leaf springs, g. a back wheel on each rear axle, h. whereby, the angular position of said back wheels relative to said platform can be varied in accordance with the positioning of the feet of the rider on said platform and the distribution of the weight of the rider on the platform.

8. The device of claim 5 and wherein the brake means comprises a cylindrically shaped member having a plurality of lateral slots.

* * * * *